US005749579A

United States Patent [19]

Piacentino

[11] Patent Number: 5,749,579

[45] Date of Patent: May 12, 1998

[54] SIMULATING THE ASSEMBLY OF AN AUTOMOBILE

[76] Inventor: Ray Piacentino, 39 Cypress Rd., Dumont, N.J. 07628

[21] Appl. No.: 764,998

[22] Filed: Dec. 16, 1996

[51] Int. Cl.[6] ..... A63F 3/00; A63F 9/24

[52] U.S. Cl. ..... 273/237; 273/238; 273/276; 273/243

[58] Field of Search ..... 273/276, 237, 273/238, 243

[56] References Cited

U.S. PATENT DOCUMENTS

| | | | |
|---|---|---|---|
| 2,620,192 | 12/1952 | Housley | 273/276 |
| 3,738,659 | 6/1973 | Partridge | 273/276 |
| 4,394,017 | 7/1983 | Maloy | 273/237 |

OTHER PUBLICATIONS

"Bicycle Breakdown", Bicycle Breakdown Inc., Playthings Magazine, Jan. 1978, p. 73.

"Right Brother", Games Unlimited Inc., Dec. 1981.

*Primary Examiner*—Benjamin H. Layno

*Attorney, Agent, or Firm*—Richard A. Joel, Esq.

[57] ABSTRACT

A board game simulating the assembly of an automobile wherein players proceed about a game board having a plurality of spaces depending upon the roll of a die. As a player lands on a particular space, he gains the right to use a specific part of an automobile in creating an assembled automobile. If a player lands on an ignition key circle, he is permitted to transfer a peg from a lock on the board to an aperture on the ignition key circle. The players compete to determine who completes the assembly first. Pick-a-card and spin spaces are also provided to furnish an additional element of excitement. After the assembly and ignition circle are complete, a player then inserts a key into the ignition slot completing a circuit to start an "engine" and signal completion of the game with a winner.

1 Claim, 4 Drawing Sheets

SIMULATING THE ASSEMBLY OF AN AUTOMOBILE

BACKGROUND OF THE INVENTION

The invention relates to board games and to a particular unique board game which is interesting and exciting. The game simulates the assembly of an automobile with the psychic experience of starting an engine to signal a "winner". The game is known by the name "REV-IT-UP".

In the prior art, U.S. Pat. No. 2,620,192 to Housley discloses an assembly line game for manufacturing automobiles. The patented game includes a game board and automobiles which are constructed with various parts. Players are assigned different assembly plants and the player who assembles the most automobiles within a certain framework, wins.

U.S. Pat. No. 5,456,473 to Whitney discloses a method and apparatus for a game board which includes various earth moving equipment relating to highway construction. The object of the Whitney game is to be the first to complete a sequence of operations on a game board simulating a highway construction project. Also of interest is Holne U.S. Pat. No. 1,574,394 which involves an automobile trip on a game board with competing players.

The following patents are more or less of general interest: U.S. Pat. Nos. 4,394,017 to Maloy; 4,563,011 to Ferris; 4,040,887 to Kemp; 5,080,369 to Mongno; and, 5,301,965 to Levin.

The game board and method of play involved in the present invention are unique and not shown in the prior art. A player completes the assembly of an automobile and closes a circuit with an ignition key signifying the game is over. The competition between players is extremely keen and the outcome usually uncertain. Furthermore, the starting of a motor when a player completes the game provides a semblance of realism to the automobile assembly.

SUMMARY OF THE INVENTION

This invention relates to a board game and particularly to a new and improved game involving the assembly of automobiles in a competition that is unusually interesting and challenging.

The winner is the first person to complete the assembly of an automobile and remove three pegs from a player's lock to an ignition key circle before placing an ignition key into an ignition slot. The key is then turned activating a circuit simulating the starting of an engine. The square game board includes a plurality of circles about the periphery of the board signifying various auto parts as well as ignition key, "pick-a-card" and "spin" circles. The players each move a "driver" of a different color about the board in accordance with the roll of a die. When landing on the pick-a-card space, the player takes a card from a pile on the board instructing him to proceed a fixed number of spaces or spin the pointer on a circle located in the center of the game board. Whether picking a "spin" card or landing on a "spin" space, the pointer is spun and points to a segment indicating color and odd/even designation on a circle. In the case of pointing to yellow-odd, the player with the yellow driver can insert a yellow odd number part into his assembly.

Finally, when the three ignition peg holes are filled for a particular color with pegs removed from a player's lock on the board, the player earns the right to insert his ignition key into the ignition slot. Turning the key completes a circuit on the underside of the board and starts the "engine" indicating a player has completed the game.

Accordingly, an objection of this invention is to provide a new and improved board game simulating the assembly of an automobile.

Another object of this invention is to provide a new and improved board game which is played by two to four players who attempt to be the first to complete an auto assembly.

A further object of this invention is to provide a challenging and exciting game wherein a plurality of players compete to be the first to assemble a particular color automobile and start the ignition.

A more specific object of this invention is to provide a new and improved board game wherein players move about spaces on a board representing auto parts, ignition key, "pick-a-card" and "spin" spaces as determined by the roll of a die, card indications and the spin of a dial in order to complete an automobile and start the ignition motor before the other players.

BRIEF DESCRIPTION OF THE DRAWING

The above and other objects and advantages of the invention may be seen when viewed in conjunction with the accompanying drawings wherein.

DETAILED DESCRIPTION OF THE INVENTION

Figure 1:
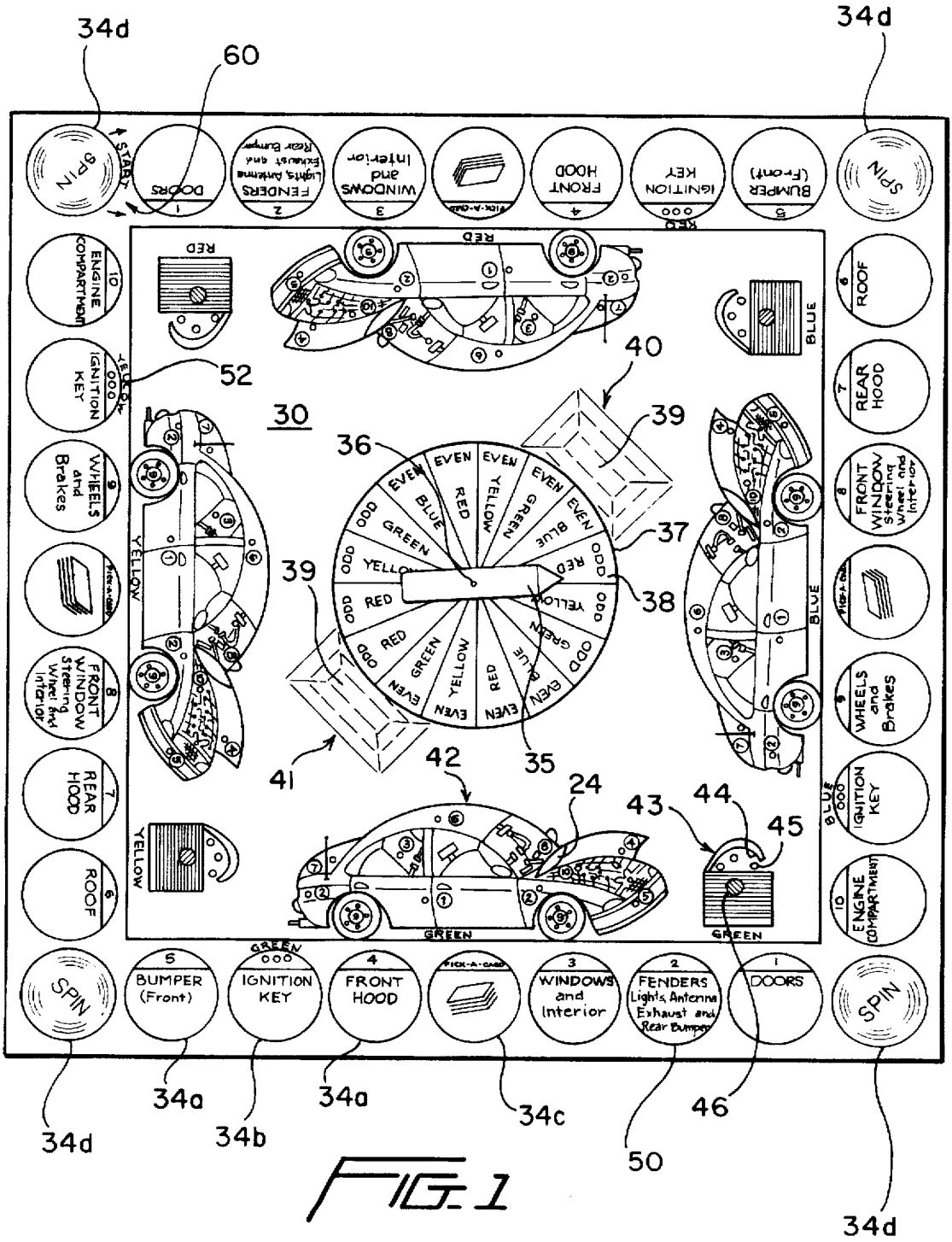
FIG. 1 is a plan view of the board used in the game comprising the invention.
Figure 2:
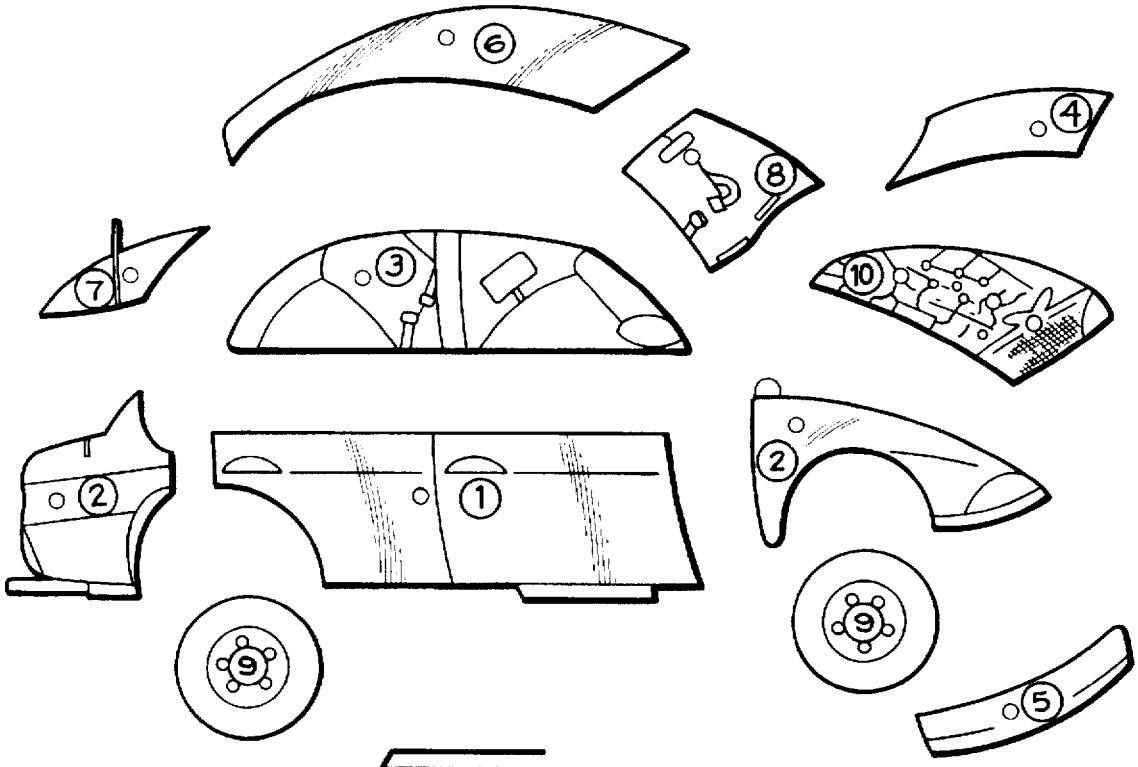
FIG. 2 is a view of the automobile assembly parts in a disassembled state.
Figure 3:
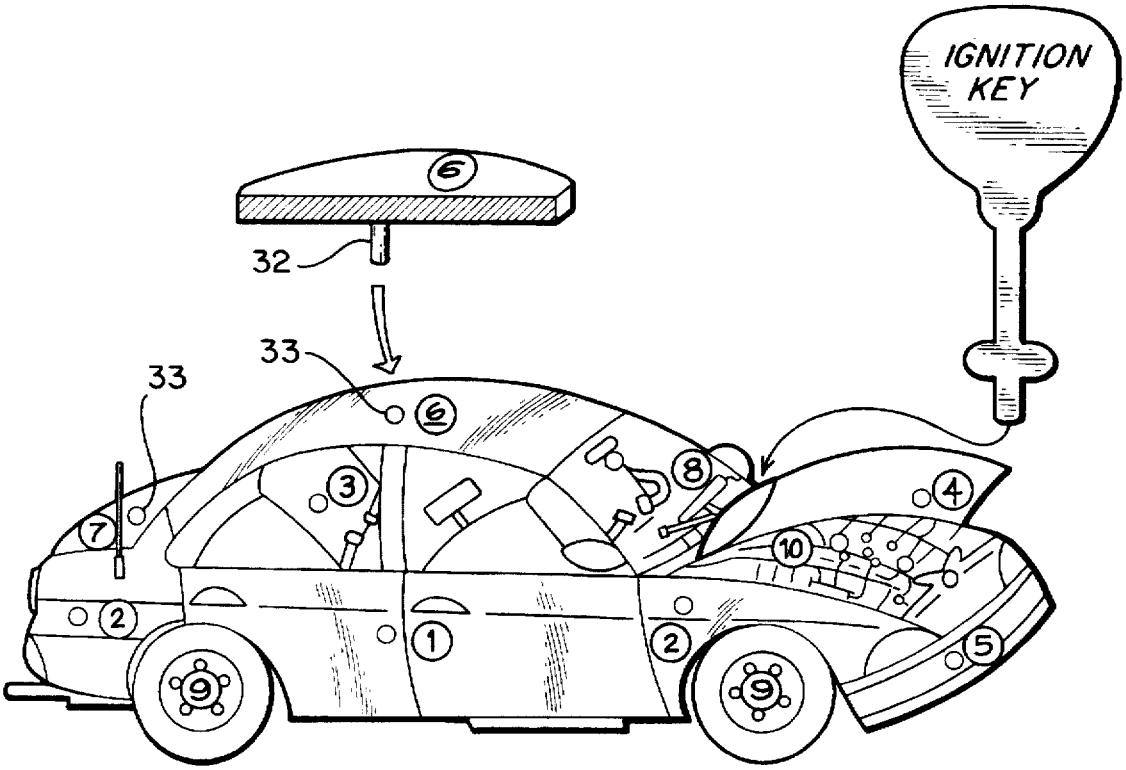
FIG. 3 is a perspective view of an outline of an assembled automobile with the ignition key slot and an enlarged ignition key.
Figure 4:
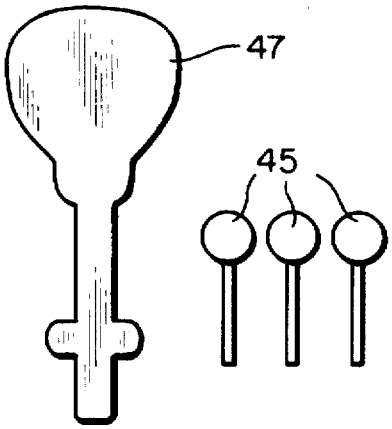
FIG. 4 is an enlarged view of the ignition key and pegs.
Figure 5:
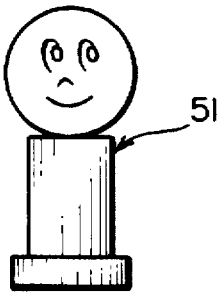
FIG. 5 is an enlarged view of a typical driver.

Referring now to the drawings, the invention comprises a board game 30 involving the assembly of an automobile 20 and the starting of a simulated automobile motor 31 to signal completion of the game 30 by a player. The game 30 may be played by two to four players who select a particular color such as blue, green, red or yellow and race to assemble and start an automobile 20 of their color. The automobile 20 consists of twelve parts which are numbered for easy placement on an outline 42 on the game board 50 by means of dowels 32 which are inserted into apertures 33 on the board 50. The parts comprise doors 1, fenders 2, windows 3, front hood 4, front bumper 5, roof 6, rear hood 7, front window 8, wheels and brakes 9 and engine 10.

The game board 50 comprises a plurality of game spaces or circles 34, ringing the periphery of the board 50. The game circles 34*a* indicate the various assembly parts of the automobile 20 such as wheels and brakes 9, roof 6, etc. Other circles 34*b* and 34*c* comprise ignition key and pick-a-card circles, respectively. The four corner circles 34*d* indicate "spin" which applies to a dial 35 which is mounted for rotation about a pivot 36 in the center of the board 50 and has a circle 37 surrounding it with indications of "odd" and "even" in each segment 38 of the circle 37 as well as a certain color. The dial 35 is spun by a player and comes to rest at a particular segment 38 which has the meaning ascribed to it in the following description. On diametrically opposed sides of the circle 37 are cards 39 which are positioned in one pile 40 with the face down and in pile 41 with the face up. Opposite each player is the outline 42 of an automobile 20 as well as a lock 43 and peg apertures 44 with pegs 45 projecting therefrom. The lock 43 also includes a key aperture 46 in which an ignition key 47 rests.

Figure 8A:
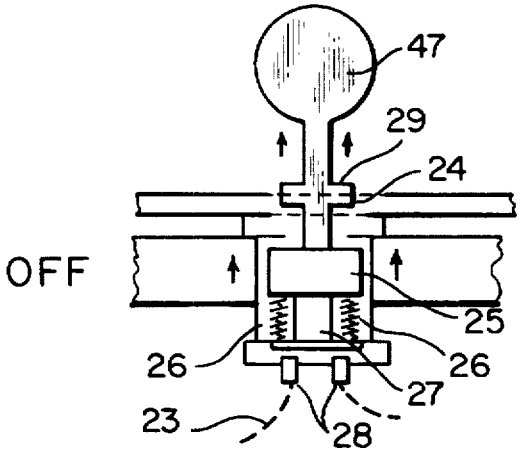
FIGS. 8*a* and 8*b* show the key in an off and on position, respectively.
Figure 6:
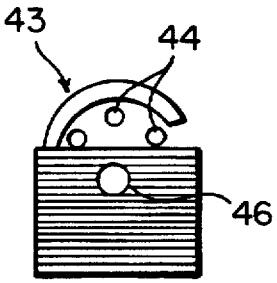
FIG. 6 is a plan view of the key lock and peg inserts located on the game board.
Figure 8B:
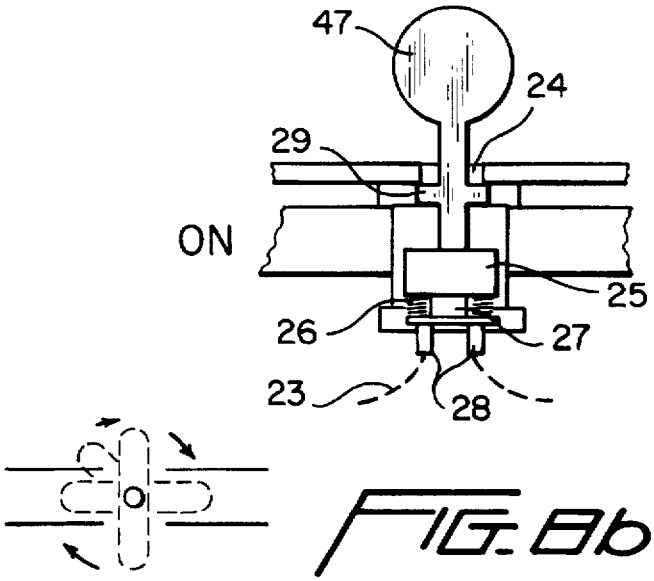
Figure 7:
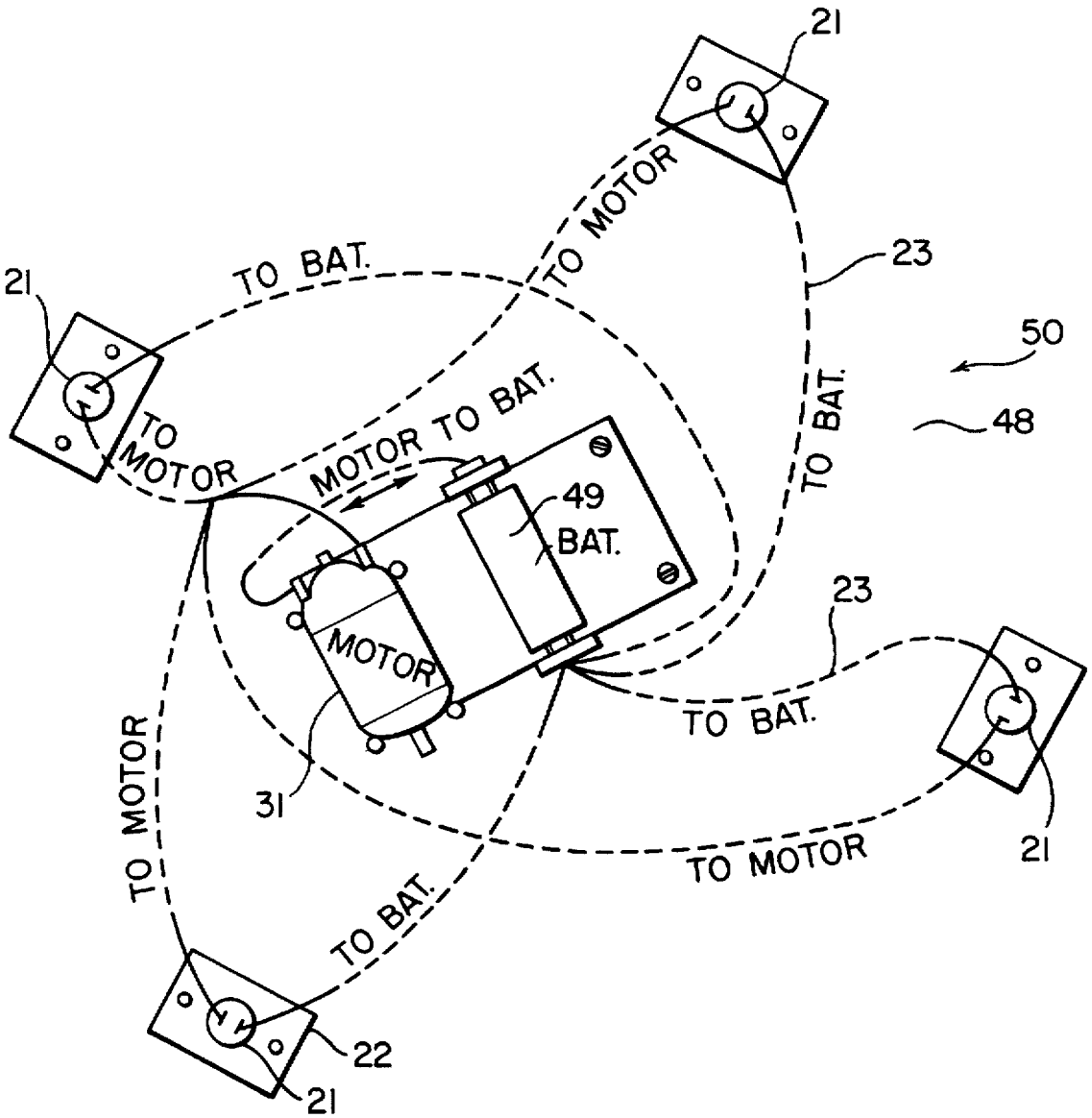
FIG. 7 is a diagram of the circuit activated by the key.

The base 48 of the board 50 includes a motor 31 which is connected to a battery 49 when the ignition key 47 is turned, completing a circuit to the motor 31. Each automobile 20 includes a push-button switch 21 see FIG. 7, which extends through a wood support 22 in the board 50 and is joined by wires 23 to the battery 49 and motor 31. The key slot 24 is depicted in FIG. 1. FIG. 8*a* shows the key 47 in an initial rest position against spring loaded element 25 backed by springs 26. A contact 27 is located on the base of element 25 for engagement with wire contacts 28 when the key 47 is depressed. The key 47 is shown in an activated position in FIG. 8*b* wherein the key 47 has been depressed with key portion 29 below the board 50 so that the spring backed element 25 with contact 27 engages wire contacts 28 to complete a circuit providing battery power to the motor 44. After depressing the key 47 the key 47 is turned locking it below the board 50 with key portions 29.

In playing the game, the object is to be the first person to complete the automobile assembly, remove three pegs 45 from the lock 43 to the ignition key circle 34*b* and place the ignition key 47 into the ignition slot 24 and turn the key 47 to start the engine 31. The first player to perform all of the above is the winner. Players initially receive twelve assembly parts 1–10, an ignition key 47, three small pegs 45 and a player's moving driver 51 which proceeds from the starting position 60 to the various circles 34*a*, 34*b*, 34*c* and 34*d* around the board 50 in accordance with the game rules.

To start the game, the first player rolls a die (not shown) and proceeds from position 60 the specified number of circles 34*a*, 34*b*, 34*c* and 34*d* on the game board 50. If, for example, the player's driver 51 lands on space number five, the player picks up the puzzle piece of designated part of the player's color and places it on player's automobile 20 in the outline 42. In this case, the part would be a green front hood 4. The next player then rolls the die and so on. Later in the game, if the same player lands on circle, front hood 4 again, the player's turn ends there and the next player rolls the die. This example also applies to any other numbered circles 34*a* on the game board. There are actually two fender pieces 2 and two wheel and brake pieces 9. A player would insert the two assembly pieces 2 instead of one when landing on circles 34*a* indicating fenders 2 or possibly wheel and brake pieces 9 or during any other method of play (die, cards, or spin) involved in this game.

There is also a "pick-a-card" circle 34*c* and when a player lands on that particular space, he picks a card 39 which instructs him to go anywhere from one to four spaces. The used card 39 is then placed in pile 41.

When rolling the die and landing on any ignition key circle 34*b*, the player's moving driver 51 stops there and a small colored peg 45 is inserted into the player's own color ignition key peg hole, which is located on player's side of game board 50. Also, when rolling a die and landing on any ignition key circle 34*b* and player's three peg holes 44 are filled with pegs 45, the player rolls again. When the three pegged holes 44 are filled with pegs 45 and the player draws another ignition key card 39, the player moves the driver 51 to the next ignition key circle 34*b* and earns another chance to roll the die. When landing on a pick-a-card space, the player picks an odd or even card of chance and places the proper assembly piece which is numbered on the assembly outline 42. For example, in the drawings, if a player has already used all the odd numbers or even numbers, one stops there and the next player rolls. The player's moving driver 51 does not move when drawing either of these cards 39 but merely the odd or even puzzle piece moves into the puzzle. As mentioned above, a player completes the game in a race with other players by assembling his automobile 20, removing the pegs 45 from the apertures 44, placing the pegs 45 into the ignition peg apertures 52 and then inserting and turning the key 47 in the slot 24 to start the engine 31.

While the invention has been explained by a detailed description of certain specific embodiments, it is understood that various modifications and substitutions can be made in any of them within the scope of the appended claims which are intended also to include equivalents of such embodiments.

What is claimed, is:

1. A game simulating the assembly of various parts to complete an automobile in a game played by a plurality of players comprising:

a game board having a plurality of playing circles arranged about the periphery of the board, said circles including circles labeled for various automobile parts, circles labeled ignition key, circles labeled spin and circles labeled pick-a-card, and the outline of an automobile opposite each player;

means for generating random numbers;

a plurality of visually distinguishable drivers, one for each player, said drivers marking the location of a player on said game board;

a plurality of automobile parts corresponding to the playing circles having labeled automobile parts shown on the game board, each of said players having automobile parts corresponding to the respective playing circles;

a plurality of cards positioned on the board relating to the pick-a-card circles and labeled with particular moves;

a rotatable dial mounted centrally on the board and a circle divided into segments extending outwardly from the dial, each of said segments being labeled with a color and an odd/even designation;

a lock positioned on the game board opposite each player having a plurality of peg apertures and a key aperture;

an ignition key and a plurality of pegs mounted in their respective lock apertures;

a power supply mounted to the game board, a motor and a contact coupling the motor to the power supply;

a means for engaging the ignition key with the contact; and, wherein the players' drivers move about the playing circles in accordance with the means for generating random numbers and the card indications to complete the automobile assembly on the board outline, remove the pegs from their apertures and lastly the ignition key from its aperture, said key being used to engage the contact to electronically activate the motor signalling completion of the game by a particular player.

* * * * *